US005201358A

United States Patent [19]

Stummer et al.

[11] Patent Number: 5,201,358

[45] Date of Patent: Apr. 13, 1993

[54] DIE-CASTING MACHINE

[75] Inventors: Friedrich Stummer, Fellbach; Wilfried Schwab, Weingarten; Wolfgang Schneider, St. Augustin; Heike Baldering, Bonn, all of Fed. Rep. of Germany

[73] Assignees: Maschinenfabrik Müller-Weingarten AG, Weingarten; Vereinigte Aluminium-Werke AG Berlin-Bonn, Bonn, both of Fed. Rep. of Germany

[21] Appl. No.: 820,083

[22] Filed: Jan. 13, 1992

[30] Foreign Application Priority Data

Jan. 21, 1991 [DE] Fed. Rep. of Germany ..... 4101592

[51] Int. Cl.[5] ..... B22D 17/10; B22D 17/20

[52] U.S. Cl. ..... 164/312; 164/337

[58] Field of Search ..... 164/312, 314, 113, 337

[56] References Cited

U.S. PATENT DOCUMENTS 4,476,911 10/1984 Lossack et al. ..... 164/312 X
4,660,614 4/1987 Spriestersbach et al. ..... 164/312 X

FOREIGN PATENT DOCUMENTS 0051310 5/1982 European Pat. Off. .
597704 5/1934 Fed. Rep. of Germany .
977014 11/1964 Fed. Rep. of Germany .
3102055 8/1982 Fed. Rep. of Germany ..... 164/312
452421 5/1975 U.S.S.R. ..... 164/312
465268 6/1975 U.S.S.R. ..... 164/312
816687 4/1981 U.S.S.R. ..... 164/312
1344509 10/1987 U.S.S.R. ..... 164/312

OTHER PUBLICATIONS

Koch, "Jahresübersicht Druckguss (20. Folge) Teil 2: Giessen, Schmelzen, Technologie," Giesserei 70 (1983), No. 19, pp. 517-518.

Spriestersbach et al., "Vergütbare Aluminium-Gussstüke-Hergestellt mittels eines neu entwickelten Vakuum-Druckgiessverfahrens," Giesserei 69 (1982), No. 19, pp. 521-527.

*Primary Examiner*—J. Reed Batten, Jr.
*Attorney, Agent, or Firm*—Spencer, Frank & Schneider

[57] ABSTRACT

In a die-casting machine for producing castings from metals or metal alloys, which castings have a low content of gas, pores and oxides, melt is drawn by means of a vacuum out of a holding device (10) via a suction tube (11) into a casting chamber (3). A casting plunger (7) closes the inlet opening (16) to the casting chamber (3). In order to achieve as low as possible mechanical surface pressure due to flow of the melt, and fluviatile erosion of the die-side end of the inlet opening (16), and thus avoid high wear of this inlet edge or of the casting chamber with casting plunger, a planar or linear inlet cross-section (24, 27) as well as a curved deflection surface (20) on the casting plunger (7) are provided.

20 Claims, 2 Drawing Sheets

DIE-CASTING MACHINE

BACKGROUND OF THE INVENTION

The invention relates to a die-casting machine for producing castings from metals or metal alloys, which castings have a low content of gas, pores and oxides.

The journal "GieBerei" 69 (1982) No. 19, page 521 ff. as well as "GieBerei" 70 (1983) No. 19, page 517 ff. have disclosed die-casting machines which work with the so-called vacuum die-casting process. Referenced is made to the advantages mentioned in this literature for the use of die-casting machines of this type.

EP No. 0,051,310 B1 (corresponding to U.S. Pat. No. 4,476,911) has disclosed a corresponding die-casting machine which likewise uses this vacuum die-casting process.

The present invention relates to a die-casting machine of this known type and combines the advantages associated with these processes.

In the application of these known die-casting machines in the vacuum die-casting process, the melt is drawn by the vacuum present in the die and in the filling chamber or casting chamber out of the holding furnace via a suction tube into the casting chamber. Here, the suction tube, at a short distance in front of the retracted casting plunger, leads perpendicularly from below into the casting chamber; i.e. the vertical surface normal to the inlet cross-section in perpendicular or virtually perpendicular to the horizontal longitudinal axis of the casting chamber.

The inlet cross-section of the suction-tube feed leading into the casting chamber is reduced with the forward movement of the casting plunger, i.e. when the front edge of the casting plunger crosses the inlet opening. At a uniform vacuum in the casting chamber, the flow velocity of the melt and thus also the type of flow of the melt are thereby increased as the cross-section of the inlet opening becomes smaller. In the case of a circular-cylindrical inlet cross-section and a front closing edge of the plunger, the inlet-opening cross-section, in the shape of a circular segment in plan view, becomes constantly smaller and ends finally in a pointlike discharge opening. This melt flowing at high velocity leads to erosion of the cross-section, which is becoming smaller and smaller, i.e. to removal of material from the cross-sectional region of the inlet opening of the suction tube to the casting chamber, which cross-sectional region is still open in the end phase. This fluviatile erosion acts especially in the region of the virtually point-like discharge cross-section in the end phase.

The melt likewise flows at high velocity in the end phase into the casting chamber and sprays with a sharp jet against the opposite side of the casting chamber and likewise leads here to removal of material. Metal particles (flake formation) arise through inclusion and solidification of the melt in this scouring, which metal particles have adverse effects on the production and the quality of the parts. Furthermore, turbulence, which is undesirable in the end phase, develops in the casting chamber.

On account of its high mechanical surface pressure due to the flow, the sharp melt jet arising in the end phase therefore leads to removal of material (fluviatile erosion) in particular from the die-side end of the inlet opening of the suction -tube feed to the casting chamber and thus to the gradual scouring of this transition. In this way, however, the closing times of the suction-tube inlet bore to the casting chamber change depending on the degree of edge wear. This leads to different metering and flake formation in the casting chamber.

The pronounced nozzle effect of the melt jet during the final phase of the casting plunger crossing the inlet opening is therefore disadvantageous in connection with wear, associated herewith, of the casting chamber and metering of the melt.

SUMMARY OF THE INVENTION

Against this background, the die-casting machine according to the invention has the advantage that the geometric shape of the inlet opening in connection with the closing edge of the casting plunger as well as the casting plunger itself are designed in such a way that lower surface loading occurs at the locations at risk or erosion. This is achieved in particular in that the melt flow in the end phase no longer occurs in a point-like manner with a pronounced nozzle effect but in a planar or linear manner at a lower flow velocity. For this purpose, the inlet-opening cross-section in the die-side end region is not only designed as a pure circular segment but is widened in its planar form, in particular rectilinearly. The pronounced nozzle effect of the melt jet in the end phase of the closing operation is thereby greatly reduced, since it is no longer a point-like jet but a planar jet which discharges from the inlet opening. But this leads to lower loading of the edges at risk of erosion.

In order to relieve both the casting plunger and the casting chamber with regard to erosion and, furthermore, in order to obtain as far as possible a laminar flow of the melt, the inlet opening of the suction tube leading into the casting chamber is arranged beneath the front plunger region of the retracted casting plunger, and the casting plunger, at its lower side facing the inlet opening of the suction -tube feed, is given a shape which produces a directed, largely turbulence-free flow. For this purpose, the casting plunger, at its side facing the inlet opening of the suction-tube feed, is especially designed in such a way that a uniform or even deflection of the melt jet is effected. This can be, for example, a tube-bend-shaped or a cylinder-barrel-shaped deflection. The deflection surface can also be formed by the casting plunger being designed as a paraboloid of revolution in its front region.

The transitional planar region of the inlet opening of the suction-tube feed to the casting chamber is preferably designed in its half facing the die as a cross-sectional region rectangular in plan view, the discharge opening being formed by the tangents at a circular cross-section.

BRIEF DESCRIPTION OF THE DRAWINGS

Further details of the invention are described below with the indication of further advantages and are shown in the drawing, in which.

DESCRIPTION OF THE PREFERRED EMBODIMENTS

With regard to the general construction as well as the essential mode of operation of the die-casting machine according to the invention, reference is made to the literature mentioned at the beginning and in particular to EP No. 0,051,310 B1 (corresponding to U.S. Pat. No. 4,476,911).

Figure 1:
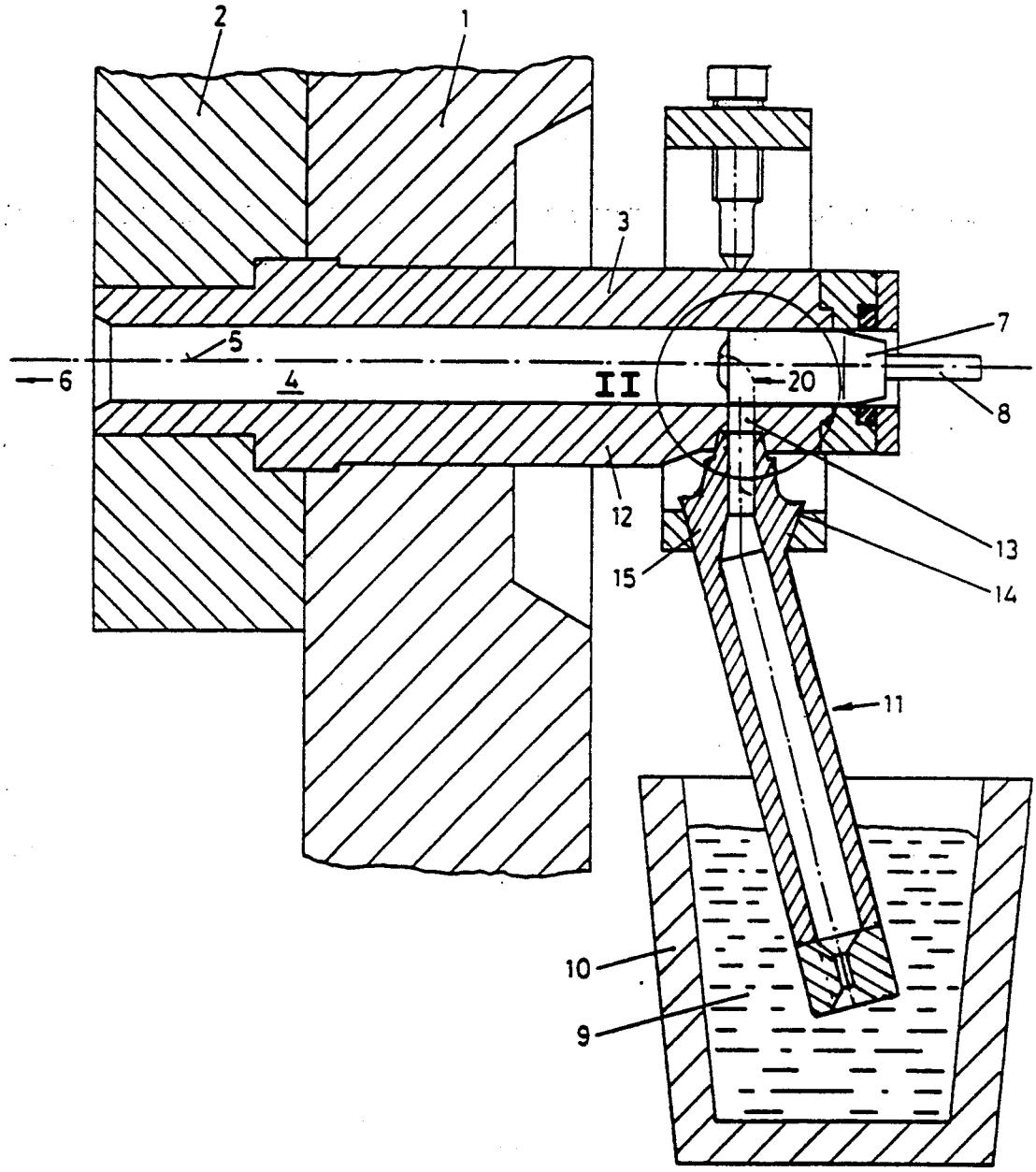
FIG. 1 shows a side view of the casting chamber with casting plunger as well as suction-tube feed to the holding device.

The fixed platen 1 of a die-casting machine (not shown in more detail) is shown in FIG. 1, which platen 1 has the fixed die half 2, which interacts with the movable die half (not shown in more detail). The filling chamber or casting chamber 3 is fixed in the fixed platen 1 as well as in the fixed die half 2. A vacuum is applied on the die side 6 to the cylindrical inner space 4 having a horizontal axis 5 of symmetry of the casting chamber 3. A casting plunger 7 having a plunger rod 8 travels horizontally in the casting chamber 3 in the direction of the die 6. The melt 9 is drawn out of a holding device 10 via a suction tube 11 into the inner space 4 of the casting chamber 3. For this purpose, a vertical bore 13 having a vertical longitudinal axis 14 is located in the lower wall section 12 of the casting chamber 3, which bore 13 is connected to the connecting flange 15 of the suction tube 11. This detail "II" is shown in greater detail in FIG. 2 with corresponding reference numerals. The plan view of the inlet opening 16 of the vertical bore 13 to the inner space 4 of the casting chamber 3 is shown in FIG. 5 (as seen the direction of arrow A in FIG. 2).

Figure 2:
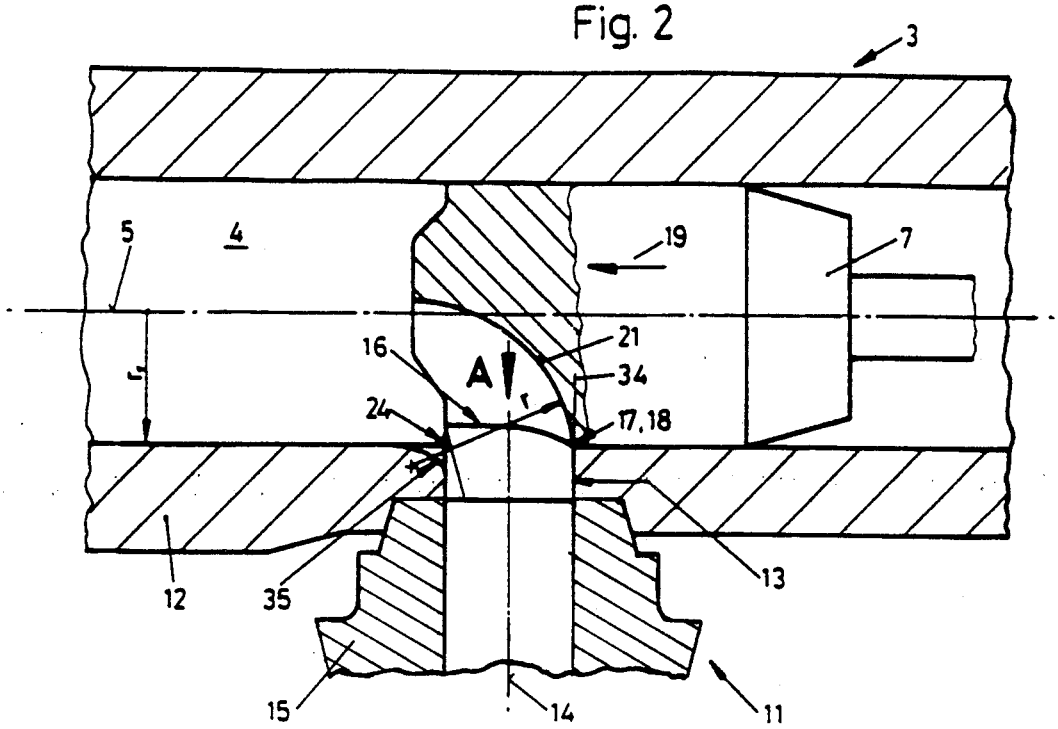
FIG. 2 shows the detail B in FIG. 1 with a casting-plunger embodiment having a tubular front deflection curve.
Figure 3:
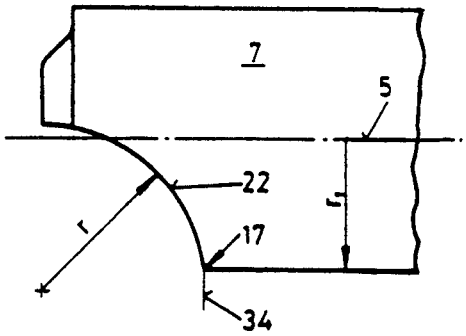
FIG. 3 shows a casting plunger having a front cylinder-barrel-shaped deflection surface.
Figure 4:
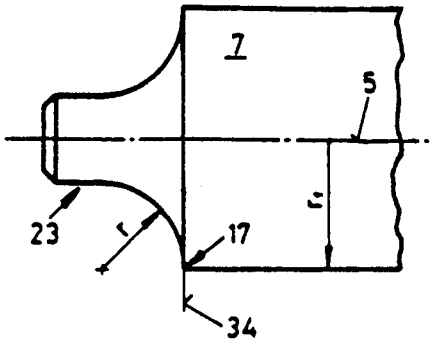
FIG. 4 shows a casting plunger having a front paraboloid of revolution.

To feed the melt 9 through the suction tube 11 and the feed bore 13 into the casting chamber 3, the opening cross-section of the inlet opening 16 must be open. For this purpose, the casting plunger 7 must be retracted to the right in FIG. 1 and FIG. 2 or must be appropriately recessed at its front lower region to such an extent that the inlet opening 16 remote from the die. In FIG. 2, the two edges 17, 18 lie one above the other, i.e. the closing edge 17 of the casting plunger 7 starts to push across the inlet opening 16. During the movement of the casting plunger 7 in arrow direction 19, the inlet opening 16 is gradually closed by the closing edge 17. The casting plunger 7 is not flat in its front region but is designed with a particular deflection surface 20 so that the open inlet opening 16 lies below the front region of the casting plunger. This deflection surface 20 is designed as a tube-bend-shaped deflection surface 21 in FIG. 2 and as a cylinder-barrel-shaped deflection surface 22 in FIG. 3. According to the representation in FIG. 4, the front region of the casting plunger 7 is designed as a paraboloid 23 of revolution for forming a corresponding deflection surface. In the embodiments of FIGS. 2–4, the closing edge 17 is arranged on the vertical tangent 34 of the respective deflection surface. The deflection surfaces 20–23 serves to smoothly deflect the melt, drawn in out of the suction tube 11, into the inner space 4 of the casting chamber 3, to produce a largely laminar flow. The more the closing edge 17 of the respective casting plunger 7 pushes across the inlet opening 16 and thus reduces the inlet cross-section, the higher becomes the flow velocity of the inflowing melt. If the closing edge 17 of the casting plunger 7 is located just in front of the die-side end (edge 24) of the inlet opening 16, the melt discharges at a very high velocity on account of the nozzle effect and has to be deflected via the deflection surface 20–23 in the horizontal direction, i.e. in the direction of the longitudinal axis 5. The casting plungers 7 in FIGS. 1 to 4 are therefore designed in their front region in such a way that the flow of melt is smoothly deflected at the deflection surface 20–23 especially when the closing edge 17 moves across the opening cross-section or the inlet opening 16 on account of the movement of the casting plunger in arrow direction 19.

The radius "r" of curvature of the tube-bend-shaped 21 (FIG. 2) or the cylinder-barrel-shaped 22 (FIG. 3) deflection surface 20, 21, 22 in the front lower region of the casting plunger is approximately the same size as or is slightly larger than the radius $r_1$ of the cylindrical inner space 4 of the casting chamber 3. If the closing edge 17 of the casting plunger is virtually on the end edge or closing edge 24 of the casting-chamber wall, the melt jet acting in a nozzle shape is deflected very smoothly by the deflection surface. The radius r of curvature of the paraboloid 23 of revolution can be about $\frac{3}{4}$ the size or $r_1$.

Figure 5:
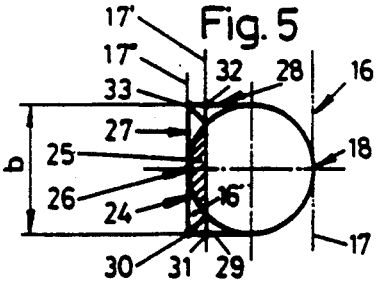
FIG. 5 shows a plan view of the inlet opening of the suction-tube feed.

Various positions of the closing edge 17 are schematically shown in FIG. 5. When the inlet opening 16 is completely open, the closing edge 17 is located in the region of the edge 18 of the inlet opening 16. In the end phase of the closing movement of the casting plunger 7, the closing edge 17 moves into the position 17' so that, in the case of a circular inlet cross-section 16, only the circular-segment region hatched with reference numeral 25 remains as an inlet area for the melt leading into the casting chamber 3. If the closing edge 17'' is located directly in front of the die-side end of the inlet opening 16, i.e. virtually on the edge 24, a point-like inlet jet remains at the point 26 in the case of a circular inlet cross-section 16. This leads to exceptionally high loading of the remaining discharge cross-section so that the removal 35 of material shown schematically in FIG. 2, i.e. a type of U-shaped scouring at the remaining inlet edge in the area of the point 26 of the lower wall section 12, is unavoidable.

The deflection of such a jet, acting in a nozzle shape, via the deflection surface 20–23, prevents the melt from impacting on the opposite side of the inner space 4 of the casting chamber. The determining factor for the considerable removal of material on this opposite side of the casting chamber is likewise the pronounced nozzle effect on account of the finally point-like discharge cross-section at point 26.

In order to obtain a lower flow velocity and thus less removal of material in the region of the inlet edge or closing edge 24 of the casting-chamber wall 12, the inlet opening 16 in the region of the die-side end, as a cross-section, is not of circular design but—as shown in FIG. 5—is of rectangular design. Accordingly, three tangents 27, 28, 29 at right angles to one another and having corresponding recesses are placed against the circular cross-section 16, which tangents 27, 28, 29 from a planar and no longer only a point-like end discharge cross-section; i.e. in the very last phase the melt not only flows at point 26 but over the full width b of the closing edge 24, 27 formed by the tangent 27, i.e. over the full width b of the inlet opening 16', which is now rectangular in this region. If the closing edge 17' is located in the position indicated in FIG. 5, the inlet cross-section or the inlet opening 16' is formed by the corner points 30–33. The circular segment 25 of a circular inlet cross-section is therefore considerably enlarged so that the flow velocity and thus the removal of material are reduced. In connection with the optimally deflected melt jet at the deflection surface 20–23, optimum guidance of the melt jet with the least possible damage to the material is thus achieved.

The invention is not restricted to the exemplary embodiment shown. On the contrary, it also comprises all further developments and refinements by persons skilled in the art within the scope of the basic idea according to the invention. In particular, the shape of the die-side inlet opening can also be designed differently than indicated in FIG. 5. Instead of placing tangents 27–29, certain curve shapes for influencing the guidance of the metal jet and for reducing the flow velocity are also possible. The closing edge 24, 27 ;of the inlet cross-section leading into the casting chamber can also be arranged in such a way as to be displaced in the direction of the die beyond the position shown in FIG. 5, so that an enlarged rectangular or trapezoidal inlet cross-section results. The determining factor is to obtain as large a cross-section of throughflow as possible until the casting chamber is finally filled with melt.

Furthermore, the embodiments of the deflection surfaces 20–23 formed with respect to the plunger 7 can also be designed differently than shown in the figures provided they achieve the same effect.

We claim:

1. An improved die-casting machine for producing castings from metals or metal alloys, which castings have a low content of gas, pores and oxides, the die-casting machine including a casting chamber (3), which has an inlet opening and which can be filled with melt from a holding device (10) via a suction tube (11) by means of a vacuum connection to a die, the die-casting machine additionally including a casting plunger (7) which is disposed in the casting chamber (3) and which is movable form an open position to a closed position during a closing operation, the inlet opening (16) being closed by the casting plunger (7) when it is in its closed position, the casting plunger (7) having a closing edge (17) which slides over the inlet opening (16) during the closing operation, wherein the improvement comprises:

a portion of the inlet opening (16) and the closing edge (17) of the casting plunger (7) are configured so that the melt flow is planar or linear as the closing operation is being completed.

2. The improved die-casting machine as claimed in claim 1, wherein the inlet opening (16) has a portion which faces the die and which is rectangular in plan view.

3. The improved die-casting machine as claimed in claim 1, wherein the casting plunger (7) has a front region which, at least on a side facing the inlet opening (16) when the casting plunger (7) is in its open position, has a curved deflection surface (20–23) for the melt, the inlet opening (16) casting plunger (7) when the casting plunger (7) is in its position.

4. The improved die-casting machine as claimed in claim 2, wherein the casting chamber (3) has a longitudinal center axis (5), and wherein the curved deflection surface of the casting plunger (7) is a spatial, three-dimensional, tube-bend-shaped deflection surface (21) which extends roughly up to the longitudinal center axis (5) of the casting chamber (3).

5. The improved die-casting machine as claimed in claim 2, wherein the casting chamber (3) has a longitudinal center axis (5), and wherein the curved deflection surface of the casting plunger (7) is a two-dimensional, cylinder-barrel-shaped deflection surface (22) which extends roughly up to the longitudinal center axis (5) of the casting chamber (3).

6. The improved die-casting machine as claimed in claim 2, wherein the casting plunger (7) has a central extension designed as a paraboloid (23) of revolution.

7. The improved die-casting machine as claimed in claim 3, wherein the curved deflection surface (20–23) has a vertical tangent, and wherein the closing edge (17) of the casting plunger (7) is disposed at the vertical tangent (34) of the curved deflection surface (20–23).

8. The improved die-casting machine as claimed in claim 3, wherein the curved deflection surface (20–23) has a radius of curvature (r), wherein the casting chamber (3) has a cylindrical or curvature (r) of the curved deflection surface (20–23) is at least as large as the radius ($r_1$) of the cylindrical inner space (4) of the casting chamber (3).

9. The improved die-casting machine as claimed in claim 6, wherein the casting chamber (3) has a cylindrical inner space (4) with a radius ($r_1$), and wherein the paraboloid (23) of revolution has a radius of curvature (r) that is about $\frac{3}{4}$ of the radius ($r_1$) of the inner space (4) of the casting chamber (3).

10. The improved die-casting machine as claimed in claim 1, wherein the inlet opening (16) has a die-side half which is rectangular in plan view and which is formed by tangents (27–29) to a circle, the tangents being positioned at right angles to one another, and wherein the inlet opening (16) additionally has another half which is semicircular in plan view, with the same radius as said circle.

11. The improved die-casting machine as claimed in claim 1, wherein the inlet opening (16) has a portion which faces the die and which is trapezoidal in plan view.

12. The improved die-casting machine as claimed in claim 2, wherein the casting chamber (3) has a longitudinal center axis, and wherein the curved deflection surface of the casting plunger (7) is a spatial, three-dimensional, tube-bend-shaped deflection surface (21) which extends to above the longitudinal center axis (5) of the casting chamber (3).

13. The improved die-casting machine as claimed in claim 2, wherein the casting chamber (3) has a longitudinal center axis (5), and wherein the curved deflection surface of the casting plunger (7) is a two-dimensional, cylinder-barrel-shaped deflection surface which extends to above the longitudinal center axis (5) of the casting chamber (3).

14. A die-casting machine for use with a die to produce metal castings from melt transferred from a holding device while the die is exposed to vacuum, comprising:

a casting chamber member having a bore that communicates with the die, the casting chamber member having a wall with an inlet opening, the inlet opening having a die-side portion which is oriented toward the die;

a suction tube to transfer the melt from the holding device into the casting chamber member through the inlet opening; and a casting plunger in the bore of the casting chamber member, the casting plunger being movable from an open position to a closed position during a closing operation, the suction tube communicating with the bore through the inlet opening when the casting plunger is in it open position and being isolated from the bore by the casting plunger when the casting plunger is in its closed position, the casting plunger having a closing edge which slides over the inlet opening during the closing operation, wherein the die-side portion of the inlet opening and the closing edge of the plunger are configured so that a ribbon-shaped stream of melt enters the bore as the closing operation is being completed.

15. The die-casting machine of claim 14, wherein the die-side portion of the inlet opening has at least one flat segment.

16. The die-casting machine of claim 14, wherein the casting plunger has a front end with a curved deflection surface which deflects the ribbon-shaped stream of melt entering the bore.

17. The die-casting machine of claim 16, wherein the bore has a longitudinal axis which passes through the curved deflection surface.

18. The die-casting machine of claim 17, wherein the curved deflection surface has a tube-bend-shaped configuration.

19. The die-casting machine of claim 17, wherein the curved deflection surface has a cylinder-barrel-shaped configuration.

20. The die-casting machine of claim 16, wherein the front end of the casting plunger is configured as a paraboloid of revolution.

* * * * *